US006257556B1

(12) United States Patent
Park

(10) Patent No.: US 6,257,556 B1
(45) Date of Patent: Jul. 10, 2001

(54) SAFETY FENCE USED ON A BUILDING BEING CONSTRUCTED

(75) Inventor: Yoon-Gi Park, Seoul (KR)

(73) Assignee: Sang Bo Construction Co., Ltd. (KR)

( * ) Notice: Subject to any disclaimer, the term of this patent is extended or adjusted under 35 U.S.C. 154(b) by 0 days.

(21) Appl. No.: 09/299,274

(22) Filed: Apr. 26, 1999

(30) Foreign Application Priority Data

Apr. 28, 1998 (KR) ..... 98-15106

(51) Int. Cl.[7] ..... B66B 9/16

(52) U.S. Cl. ..... 256/1; 256/DIG. 6; 187/239; 187/241; 187/242; 187/401

(58) Field of Search ..... 256/1, DIG. 6, 256/DIG. 2, 59; 187/239, 401, 241, 242

(56) References Cited

U.S. PATENT DOCUMENTS

| | | | | |
|---|---|---|---|---|
| 377,266 | * | 1/1888 | Naylor | 187/401 X |
| 819,419 | * | 5/1906 | Franklin | 187/401 X |
| 2,647,675 | * | 8/1953 | Bernett | 187/401 X |
| 3,207,293 | * | 9/1965 | Cull | 187/241 |
| 3,763,964 | * | 10/1973 | Davis | 187/239 |
| 3,881,699 | * | 5/1975 | Nusbaum | 256/59 |
| 4,042,066 | * | 8/1977 | Noone | 187/401 X |
| 4,073,382 | * | 2/1978 | Fahey et al. | 187/239 X |
| 4,469,198 | * | 9/1984 | Crump | 187/401 X |
| 4,557,353 | * | 12/1985 | Pichon | 187/401 X |
| 5,014,822 | * | 5/1991 | Chapelain et al. | 187/401 X |
| 5,299,781 | * | 4/1994 | Barrett et al. | 256/1 X |
| 5,630,572 | * | 5/1997 | Guay | 256/1 |
| 5,690,317 | * | 11/1997 | Sandsborg | 256/1 |

FOREIGN PATENT DOCUMENTS

| | | | | |
|---|---|---|---|---|
| 1423718 | * | 9/1988 | (SU) | 256/DIG. 6 |
| 924329 | * | 9/1988 | (SU) | 256/DIG. 6 |

* cited by examiner

*Primary Examiner*—Lynne H. Browne
*Assistant Examiner*—David E. Bochna
(74) *Attorney, Agent, or Firm*—Baker & McKenzie

(57) ABSTRACT

A safety fence used in a field of a construction work includes a guide rail disposed parallel to an outer wall of a building being constructed. A fence frame is disposed to cover the outer wall and movable along the guide rail and an elevating device for moving the fence frame along the guide rail provided. A tent is disposed on the fence frame. A net for reinforcing the tent may be fixedly disposed on the fence frame. The fence frame includes a plurality of platforms that are vertically connected to each other in a multi-story structure. The platforms are connected to each other by braces.

5 Claims, 9 Drawing Sheets

Fig. 7
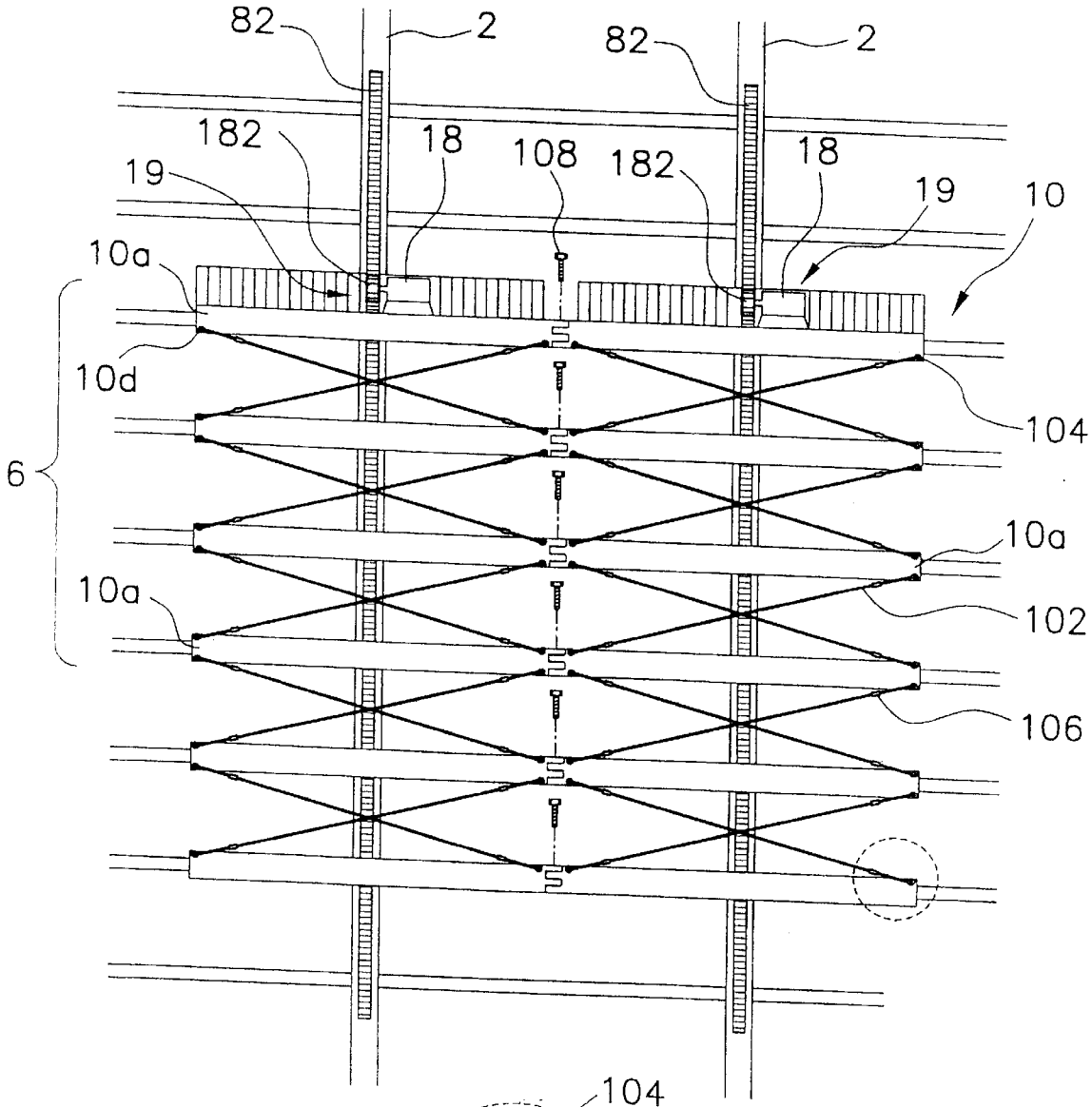
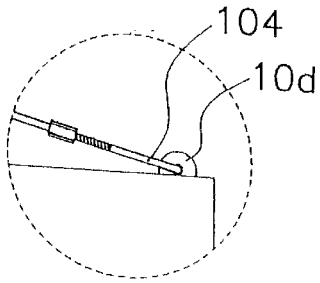
Fig. 7A

SAFETY FENCE USED ON A BUILDING BEING CONSTRUCTED

BACKGROUND OF THE INVENTION

1. Field of the Invention

The present invention relates to a safety fence and, more particularly, to a safety fence that is mounted on an outer wall of a building being constructed to prevent various accidents and catch falling objects including debris.

2. Description of Related Arts

The average height of buildings in most cities is increasing in an effort to more effectively use land. In addition, as construction technology develops, rapid construction methods have been pursued.

However, while there have been great strides in construction technology, the development of a temporary structure that can support the high-rise building under construction and the rapid construction methods has been relatively limited. If the temporary structure is not built on an outer wall of a building being constructed, a worker may be injured or killed in a fall and building materials such as blocks and other objects may fall to the ground, causing the build-up of trash around the building and possible injuries to persons in proximity to the building.

To solve the above problems, a tent has been setup to cover the outer wall of the building, or a falling preventing net has been pitched in a direction perpendicular to the outer wall of the building. However, such a tent or net may be destroyed or damaged due to the myriad of atmospheric conditions when it is setup on a superhigh-rise building. In addition, when building materials are dropped from a high story, the objects may penetrate the tent or net as a result of the high speed at which the objects strike the tent or net, causing safety accidents.

In addition, such a tent or net is troublesome to pitch. Also, when pitching the tent or net, since there is no device for providing safety to the workers setting up the tent or net, these workers may face serious injuries if they fall.

SUMMARY OF THE INVENTION

Therefore, the present invention has been made in an effort to solve the above described problems.

It is an object of the present invention to provide a safety fence which can completely catch minute particles such as concrete dust as well as heavy objects such as building materials, thereby preventing environmental pollution and industrial accidents.

To achieve the above object, the present invention provides a safety fence used in a field of a construction work, comprising a guide rail disposed parallel to an outer wall of a building being constructed, a fence frame disposed to cover the outer wall and movable along the guide rail, elevating means for moving the fence frame along the guide rail, and a tent disposed on the fence frame.

The safety fence may further comprises a net for reinforcing the tent, the net being fixedly disposed on the fence frame.

The fence frame comprises a plurality of platforms that are vertically connected to each other in a multi-story structure. The platforms are connected to each other by braces. The fence frame comprises a plurality of platforms that are horizontally connected to each other by a fastener. Preferably, the elevating means is disposed on a top platform.

According to one embodiment of the present invention, the elevating means comprises a drive source, a spool directly connected to the drive source, and a rope releasably wound around the spool, a free end of the rope extending downward, then further extending upward via the fence frame, and being fixed on the building.

According to another embodiment of the present invention, the elevating means comprises a drive source, a pinion directly connected to the drive source, a rack meshed with the pinion and integrally formed on an outer wall of the building.

BRIEF DESCRIPTION OF THE DRAWINGS

The accompanying drawings, which are incorporated in and constitute a part of the specification, illustrate an embodiment of the invention, and, together with the description, serve to explain the principle of the invention:

FIG. 7 is a front view illustrating a safety fence according to a second embodiment of the present invention;

FIG. 7A is an enlarged view of a portion of the safety fence illustrated in FIG. 7;

DETAILED DESCRIPTION OF THE PREFERRED EMBODIMENTS

Preferred embodiments of the present invention will now be described in detail with reference to the accompanying drawings.

Figure 1:
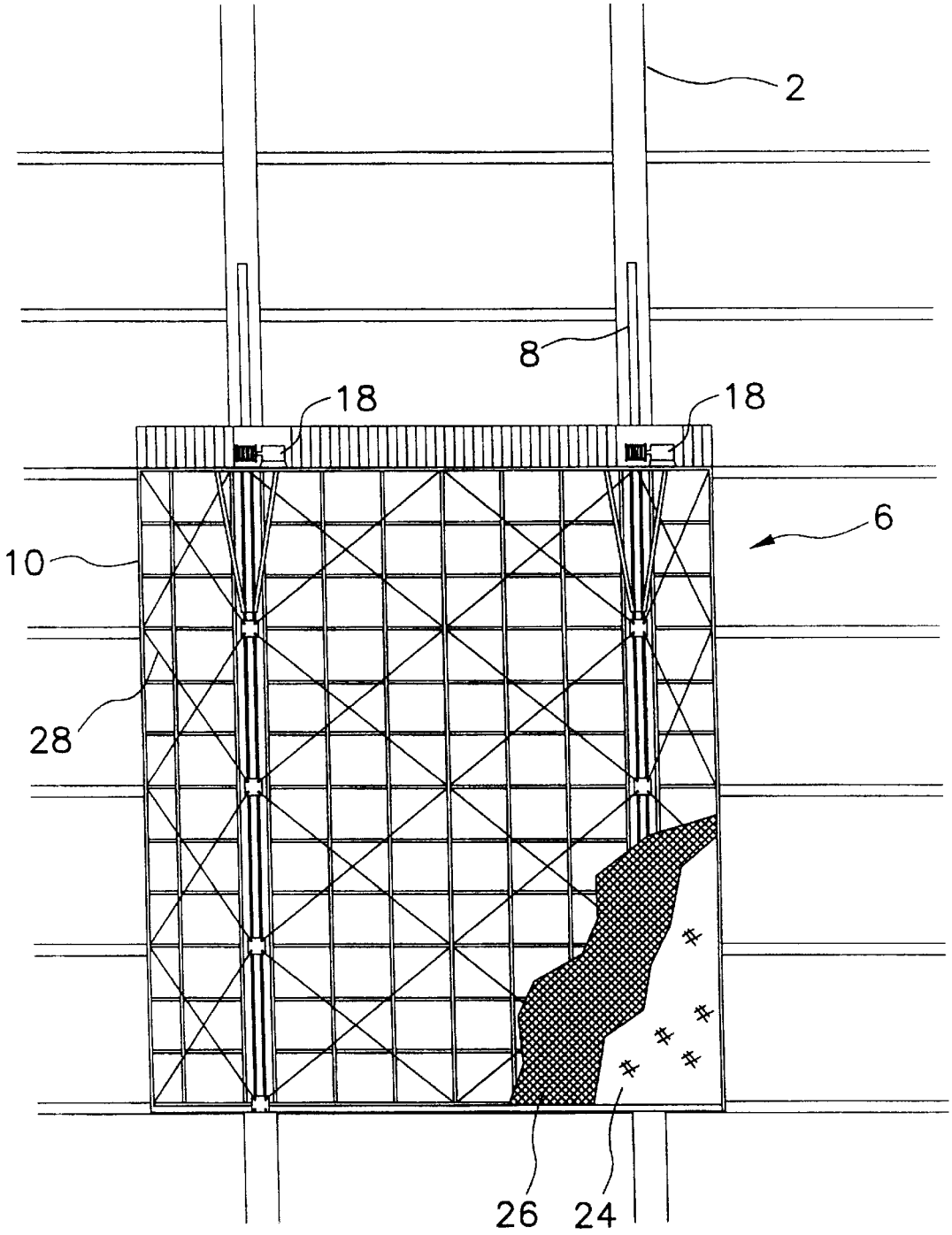
FIG. 1 is a schematic view of a safety fence according to a first embodiment of the present invention.
Figure 2:
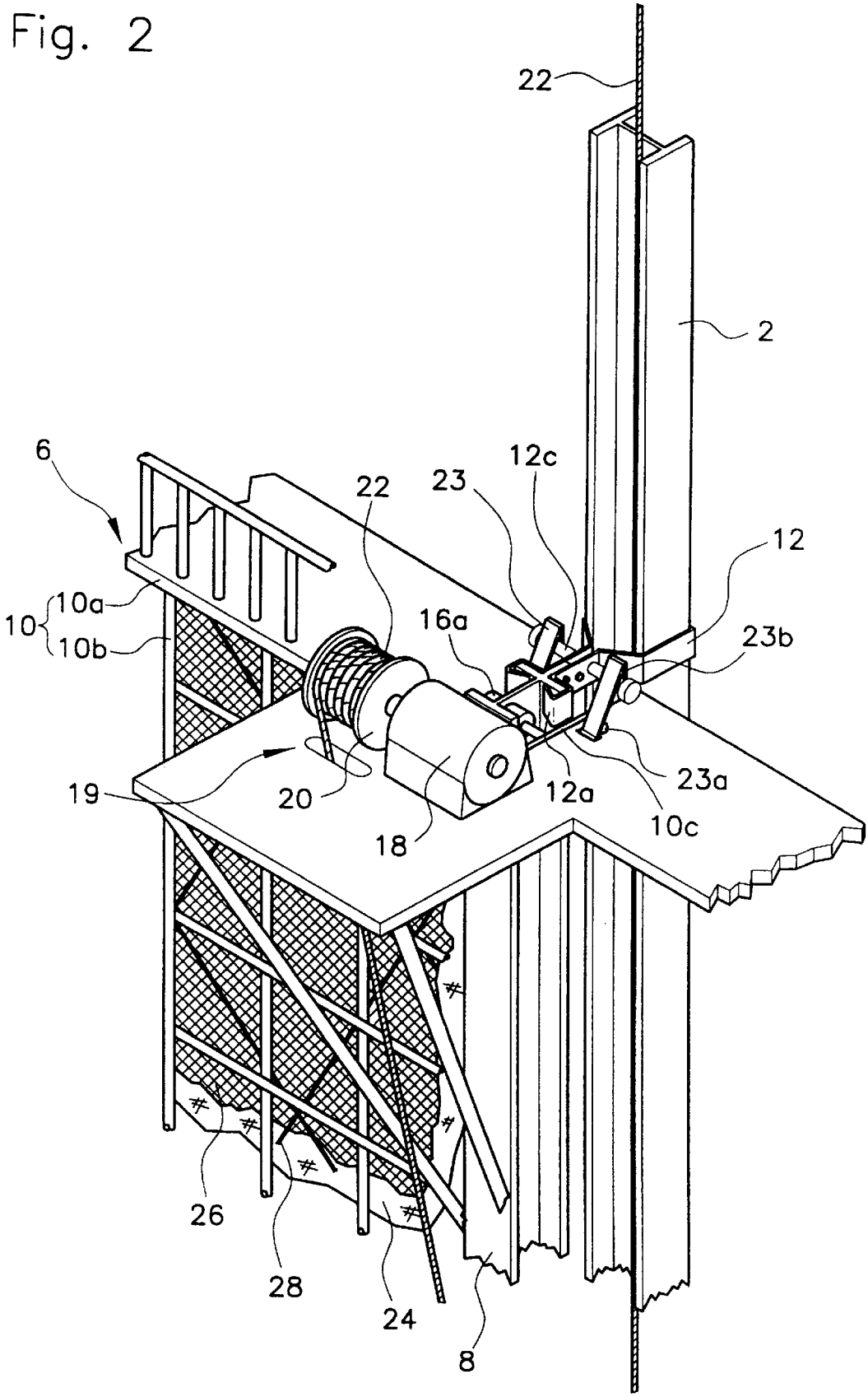
FIG. 2 is an enlarged view illustrating major parts of a safety fence according to a preferred embodiment of the present invention.

FIGS. 1 and 2 shows a safety fence used on building being constructed according to a first embodiment of the present invention, in which reference numeral 2 indicates a frame of a building being constructed. The frame 2 is an H-beam or a reinforced concrete-beam(RC-beam). The frame 2 constitutes a basic structure of the building by being assembled with horizontal girders which are disposed on each story of the building.

A safety fence 6 of the present invention is built on an outer wall of the frame 2. In the drawing, the safety fence is sized corresponding to two stories of the building, but, if required, the size of the safety fence 6 can be adjusted to different sizes.

The safety fence 6 is mounted on the frame 2 such that it is movable in a vertical direction. This will be described hereinafter more in detail.

The safety fence 6 comprises a guide rail 8 vertically mounted on the outer wall of the frame 2 and a fence frame 10 coupled on the guide rail 8 and movable in a vertical direction along the guide rail 8. The fence frame 10 includes a framework 10*b* having a plurality of bars that are fixedly arranged in a matrix-shape and a platform 10*a* mounted on a top of the framework 10*b*. A lower portion of the fence frame 10 is composed of a framework 10*b* which is formed of a plurality of bars that are fixed in a matrix-shape. In a substantial application, the platform and framework 10*a* and 10*b* can be arranged in a multi-story structure in accordance with the number of stories of the building.

Figure 3:
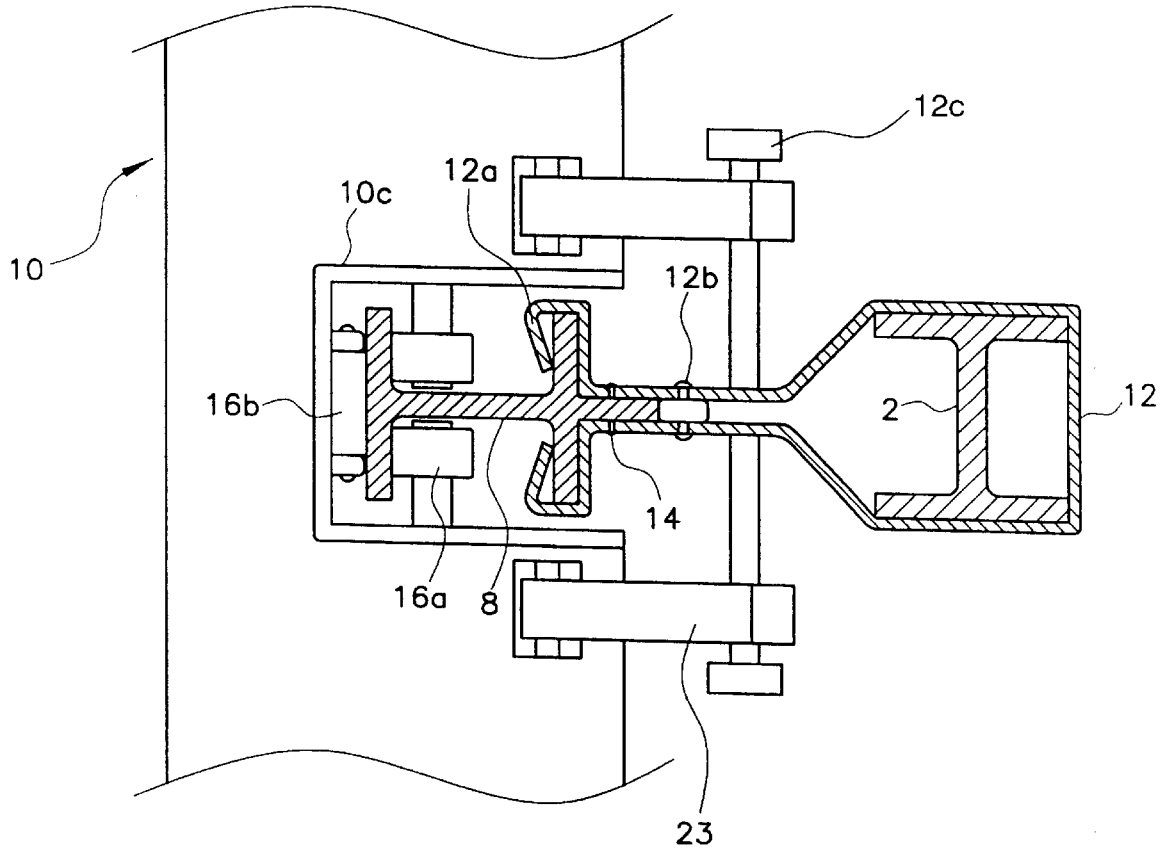
FIG. 3 is a sectional view illustrating a connecting structure between a fence flame and a rail which are depicted in FIG. 2.

As shown in FIG. 3, the guide rail 8 for guiding the movement of the fence frame 10 is disposed parallel to the frame 2 by a rail holder 12*a* fixed by a fastener 14 on an extreme end of a band 12 slidably enclosed around the frame 2 of the building being constructed. It is preferable that the band 12 is provided on each story to securely support the guild rail 8.

In addition, provided on the fence frame 10 are rollers 16*a* and 16*b* rolling along the guide rail 8 so as to smoothly move the fence frame 10 in the vertical direction.

Describing more in detail, the rollers 16*a* and 16*b* are arranged inside a bracket 10*c* formed on the fence frame 10 such that they respectively contact outer and inner surfaces of the guide rail 8 to prevent the fence frame 10 from being tilted when moving in the vertical direction.

The rollers 16*a* and 16*b* are provided to each platform 10*a* which is arranged in a multi-story configuration to securely support the corresponding platform 10*a*.

Provided on the top of the fence frame 10 is an elevating device 19. In this embodiment, the elevating device 19 comprises a driving source 18 such as a motor, a spool 20 driven by the driving source 18, and a rope wound around the spool 20.

Figure 4:
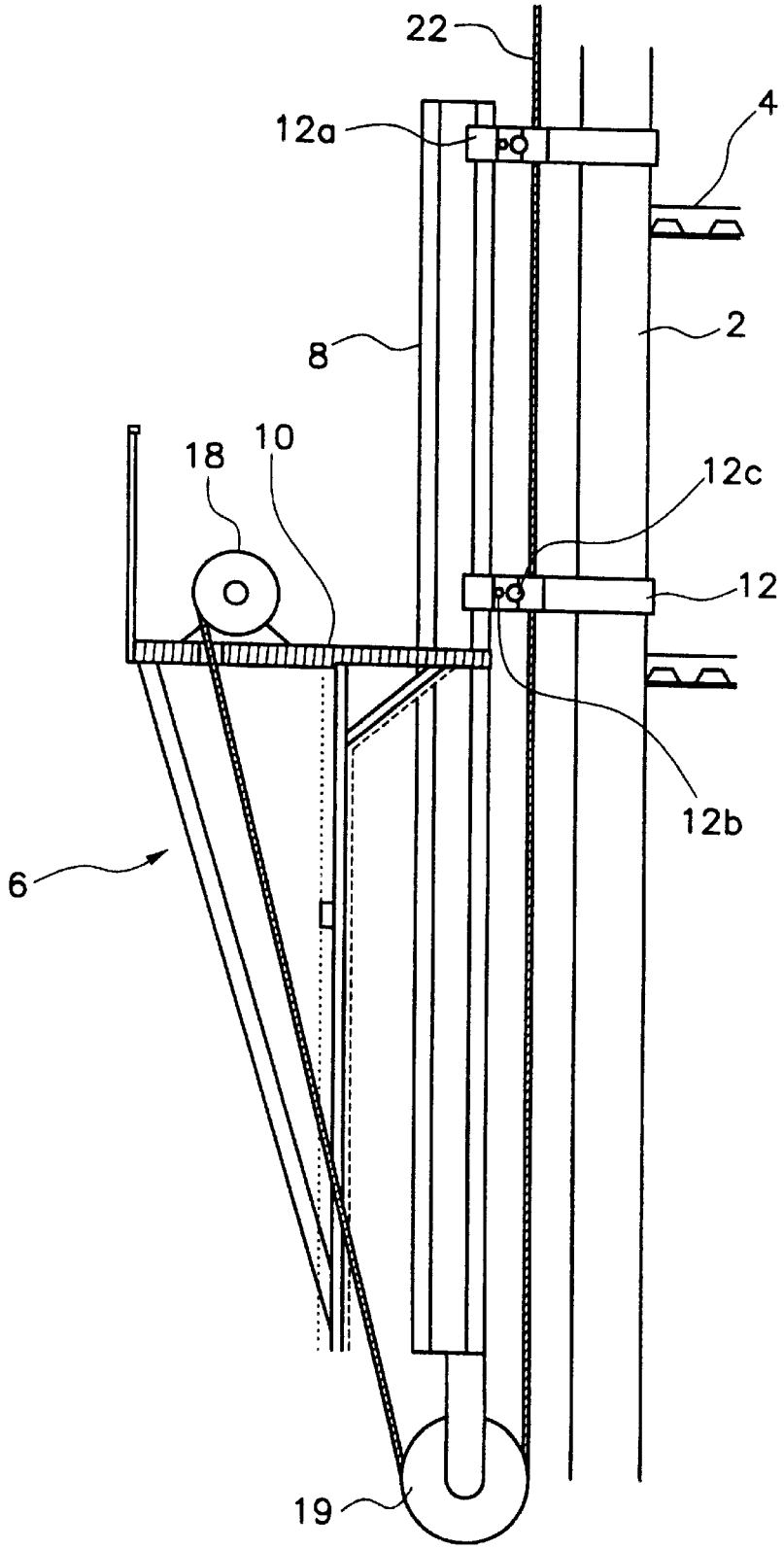
FIG. 4 is a schematic view illustrating a connecting structure between a fence flame and an elevating member which are depicted in FIG. 2.
Figure 5:
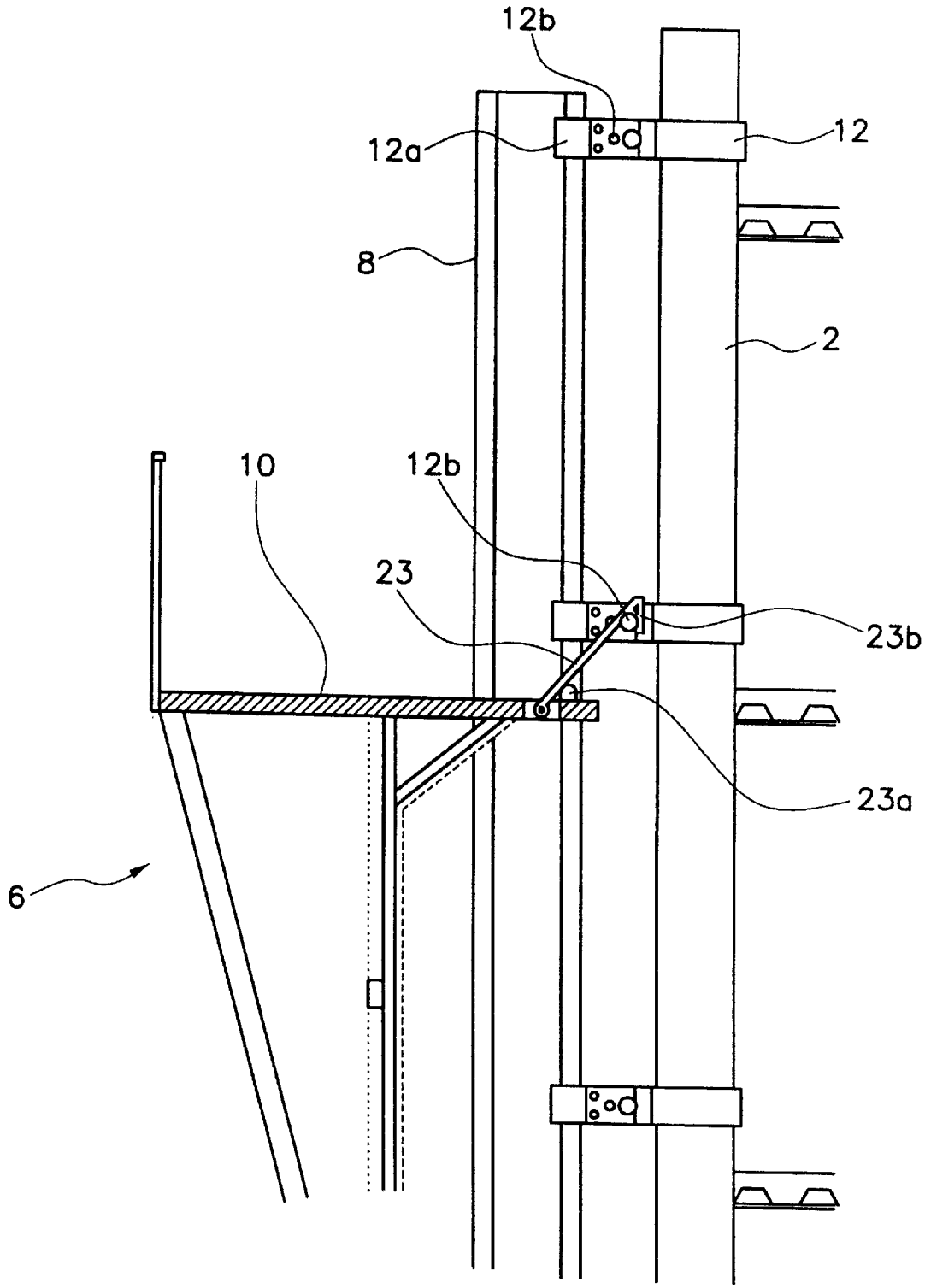
FIG. 5 is a sectional view illustrating a hook-suspending structure of a fence flame depicted in FIG. 2.

As shown in FIG. 4, one end of the rope 22 extends downward through the platform 10*a*, then further extends upward via a roller 19 mounted on a bottom of the guide rail 8 to be fixed on the band 12.

When the driving source 18 drives forward to wind the rope 22 around the spool 20, the fence frame 10 moves upward along the guide rail 8 by the rope 22. When the driving source 18 drives reversely to release the rope 22, the fence frame 10 moves downward along the guide rail 8. An electromagnetic brake device may be applied to the driving source 18 to precisely adjust the movement of the fence frame 10.

Hooks 23 hooked on a fixing bar 12*c* mounted on the band 12 are provided on the platform 10*a* to further securely support the fence frame 10. The hooks 23 are inclined toward the frame 2 of the building and supported by stoppers 23*a*. When the fence frame 10 moves upward, front inclined portions 23*b* of the hooks 23 are designed to automatically hook on the fixing bar 12*c*, thereby securely supporting the platform 10*a*.

The guide rail 8 may, if required, be displaced along the frame 2 of the building. For example, in the state where the fence frame 10 is fixed on the frame 2 and the guide rail 8 is separated from the frame 2 by releasing the fastener 14 fixed on the extreme end of the band 12, the guide rail 8 can be displaced along the frame 2 by winding and releasing the rope 22 by operating the elevating device 19.

After the guide rail 8 is displaced with respect to the frame 2, the guide rail 8 is fixed on the frame 2 using the fastener 14. For the smooth displacement of the guide rail 8, a roller 12*b* may be provided inside the band 12.

Provided on an inner surface of the fence frame 10 is a tent 24 for preventing minute material such as dust from falling to the ground outside the building. Preferably, the tent 24 comprises a sheet made of a poly vinyl chloride (PVC) material, at least a layer of which is disposed on the framework 10*b* of the fence frame 10. A reinforce net 26 may be formed on an outer surface of the tent 24 so that the tent 24 can, when the safety fence 6 is mounted on a high story of a building being constructed, withstand strong winds and prevent heavy materials and workers from falling. The net 26 is preferably made of a metal mesh that can be attached on the fence frame 10.

The above described safety fence 6 can be built on each outer wall of the building so as to completely cover the outer circumference of the building. Accordingly, dust and minute particles generated during construction can be interrupted by the tent 24, thereby preventing environmental pollution. Furthermore, since the net 26 is made to securely catch heavy objects such as blocks and even workers, industrial accidents are prevented.

In addition, since the building can be completely covered with the net 26, construction work can be carried out even under bad weather conditions, minimizing the construction time.

Figure 6:
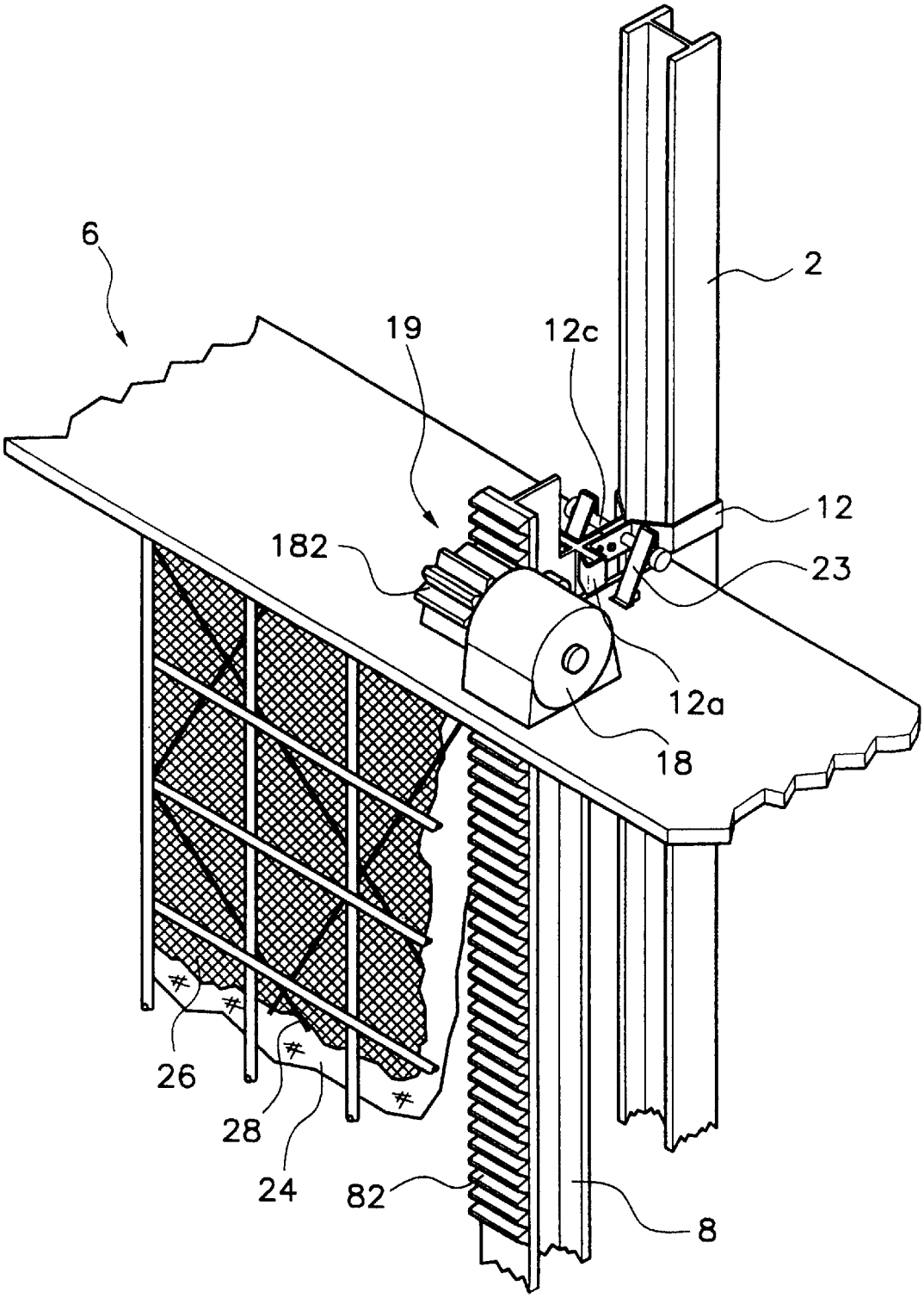
FIG. 6 is a perspective view illustrating a modified example of an elevating member.

In addition, the elevating device may be modified as shown in FIG. 6.

A modified device 19 comprises a rack 82 and a pinion 182. The rack 82 is integrally formed on the guide rail 8, which is supported on the frame 2 by the band 12 and the rail holder 12*a*, and meshed with the pinion 182 directly connected to the driving source 18.

As the pinion 182 is driven by the driving source 18, the pinion 182 moves vertically along the rack 82, thereby moving the safety fence 6 in a vertical direction.

Figure 8:
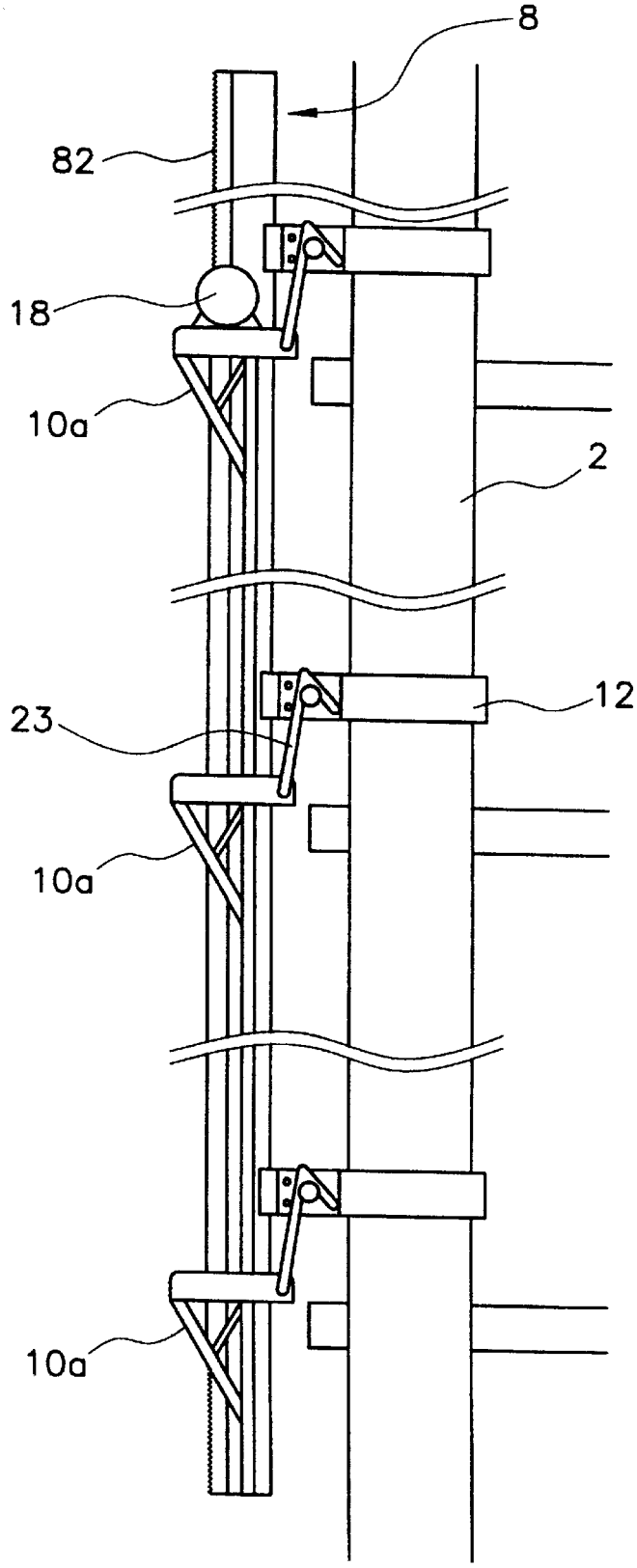
FIG. 8 is a schematic side view illustrating a constructing state of a safety fence depicted in FIG. 7.
Figure 9:
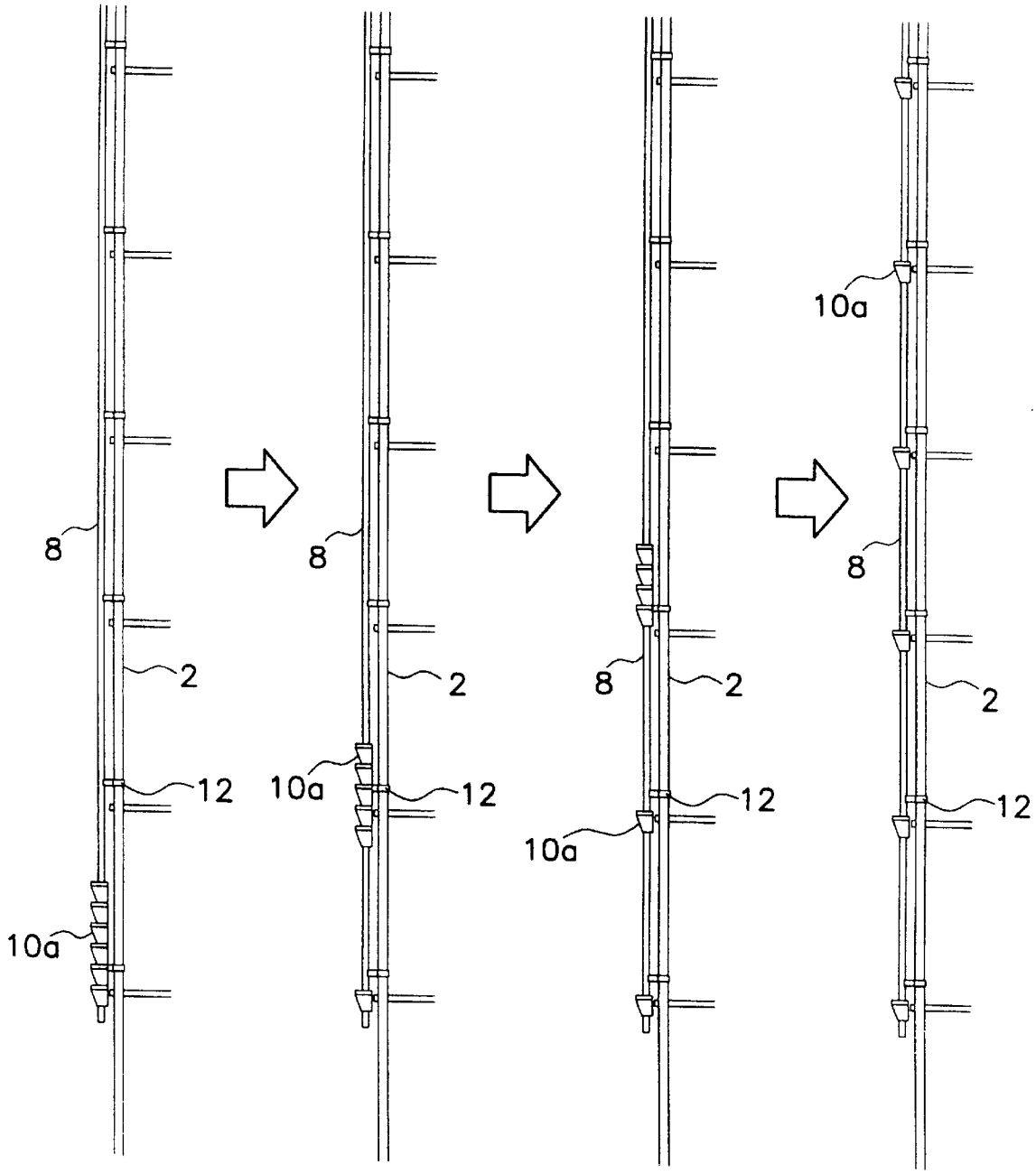
FIG. 9 is a view illustrating a constructing process of a safety fence depicted in FIG. 7.

FIGS. 7 to 9 show a safety fence according to a second embodiment of the present invention.

In a safety fence according to this embodiment, a truss-type platform 10*a* of the fence frame 10 can be separated as a unit so that the net 26 can be easily assembled on a building undergoing construction.

The truss-type platform 10*a* is mounted on each story, in which, when one platform 10*a* is elevated by the elevating device 19, another platform 10*a* is assembled to the one platform 10*a*, thereby providing a multi-story structure.

Formed on an edge of the platform 10*a* are eyelets 10*d* in which latches 104 formed on ends of braces 102 are inserted to connect one platform to another platform, as shown in FIG. 7A. Preferably, a turn-buckle 106 is provided to each brace 102 so that the length of the brace 102 can be adjusted. This makes the platforms 10*a* correspond to the height of each story.

By the above described structure, a plurality of the platforms 10*a* may be successively connected to cover five to seven stories of a building. The multi-story fence frame 10 can be moved in a vertical direction along the frame 2 in the same manner as that described in the first embodiment.

In addition, the platforms 10*a* adjacent each other on the same horizontal plane may be coupled to each other by fasteners 108 so as to cover a relatively large outer wall.

In this embodiment, an elevating device 19 comprises a rack 82 integrally formed on the fence frame 10, a driving source 18, and a pinion 182 directly connected to the driving source 18 and meshed with the rack 82. When the frame 10 is moved in the vertical direction, the same is securely supported on the frame 2 by hooks 23.

Like the first embodiment, a tent 24 and a net 26 are mounted on inner surfaces of the braces 102.

As shown in FIG. 9, the safety fence disclosed in the second embodiment is built as the platforms 10*a* are unfolded one by one and thus the braces 102 which are folded between the platforms 10*a* are unfolded. After the platforms 10*a* are completely unfolded, the tent 24 and the net 26 are attached on the braces 102 to cover the outer wall of the building being constructed.

Preferably, the platforms 10*a* are folded at the lowest story and advanced upward one by one when the fence is built. When removing the fence from the building, in the state where the top platform 10*a* is suspended on a tower crane, the fence frames 10 are separated from the frame 2 by releasing the bands 12. The separated fence frames 10 are loaded on the ground, and the platforms 10*a* are separated from the guide rail 8 by releasing the hooks 23. All of the separated parts are then loaded on a truck.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. A safety fence for use with a building being constructed, the safety fence employing a rope and comprising:

a guide rail disposed parallel to an outer wall of the building being constructed;

a fence frame disposed to cover the outer wall and movable along the guide rail, wherein the fence frame comprises a plurality of platforms that are vertically connected to each other in a multi-story structure;

elevating means for moving the fence frame along the guide rail, wherein the elevating means is disposed on a top platform and comprises a driving source, a spool directly connected to the driving source, with the rope releasably wound around the spool, a free end of the rope extending downward, then further extending upward via the fence frame, and being fixed on the building; and a tent disposed on the fence frame.

2. The safety fence of claim 1 further comprising a net for reinforcing the tent, the net being fixedly disposed on the fence frame.

3. The safety fence of claim 1 wherein the platforms are connected to each other by braces.

4. The safety fence of claim 1 wherein the fence frame comprises a plurality of platforms that are horizontally connected to each other by a fastener.

5. A safety fence for use with a building, the safety fence employing a rope and comprising:

a guide rail disposed parallel to an outer wall of the building;

a fence frame disposed to cover the outer wall and movable along the guide rail, wherein the fence frame comprises a plurality of platforms that are vertically connected to each other;

elevating means for moving the fence frame along the guide rail, wherein the elevating means is disposed on a top platform and comprises a driving source, a spool directly connected to the driving source, with the rope releasably wound around the spool, and being coupled to the building; and a tent disposed on the fence frame.

* * * * *